US009394767B2

(12) United States Patent
Brooks et al.

(10) Patent No.: US 9,394,767 B2
(45) Date of Patent: Jul. 19, 2016

(54) TRANSIENT CONTROL OF WELLBORE PRESSURE

(71) Applicant: Hunting Titan, Inc., Pampa, TX (US)

(72) Inventors: James E Brooks, W. Montgomery, TX (US); Nolan C Lerche, Stafford, TX (US)

(73) Assignee: Hunting Titan, Inc., Pampa, TX (US)

( * ) Notice: Subject to any disclaimer, the term of this patent is extended or adjusted under 35 U.S.C. 154(b) by 471 days.

(21) Appl. No.: 13/815,187

(22) Filed: Feb. 7, 2013

(65) Prior Publication Data

US 2013/0220613 A1 Aug. 29, 2013

Related U.S. Application Data

(60) Provisional application No. 61/633,268, filed on Feb. 8, 2012.

(51) Int. Cl.

| | |
|---|---|
| ***E21B 43/116*** | (2006.01) |
| ***E21B 43/1185*** | (2006.01) |
| ***E21B 43/11*** | (2006.01) |
| ***F42D 1/05*** | (2006.01) |
| ***F42B 12/10*** | (2006.01) |
| ***F42D 1/04*** | (2006.01) |
| ***F42D 3/00*** | (2006.01) |
| ***E21B 29/02*** | (2006.01) |
| ***E21B 43/119*** | (2006.01) |

(52) U.S. Cl.

CPC ..... *E21B 43/11* (2013.01); *E21B 29/02* (2013.01); *E21B 43/116* (2013.01); *E21B 43/119* (2013.01); *E21B 43/1185* (2013.01); *F42B 12/10* (2013.01); *F42D 1/04* (2013.01); *F42D 1/05* (2013.01); *F42D 3/00* (2013.01)

(58) Field of Classification Search

CPC . E21B 43/116; E21B 43/117; E21B 43/1185; E21B 43/11852; E21B 43/11855; E21B 43/11857

See application file for complete search history.

(56) References Cited

U.S. PATENT DOCUMENTS

| | | | | | |
|---|---|---|---|---|---|
| 3,151,679 | A | * | 10/1964 | Karpovich et al. | 166/299 |
| 3,163,112 | A | * | 12/1964 | Rhea | 102/310 |
| 4,329,925 | A | * | 5/1982 | Hane et al. | 102/310 |
| 4,805,726 | A | | 2/1989 | Taylor et al. | |

(Continued)

OTHER PUBLICATIONS

L.A.Behrmann et al, Effects of Wellbore Pressure on Perforator Penetration Depth; Soc of Petrol. Engrs #18243: Oct. 2-5, 1988.

(Continued)

*Primary Examiner* — Frederick L Lagman

(74) *Attorney, Agent, or Firm* — Jason Saunders; Arnold, Knobloch & Saunders, L.L.P.

(57) ABSTRACT

A method and apparatus is described for modifying downhole wellbore pressure at the instant that an explosive event occurs. By a significant temporary reduction in wellbore pressure, for example, an explosive cutter will be able to cut through thicker pipe in a deep well with high hydrostatic pressure. A favorable transient wellbore pressure is achieved by the selective timing of implosion and explosion devices, to improve the performance of certain explosive tools when subsequently initiated, such as shaped charge explosive cutters, severing tools, setting tools and perforating guns. As part of the system, each implosion or explosion device is initiated by a detonator having a preprogrammed control unit with a preselected timing delay to take advantage of the temporarily lowered wellbore pressure.

21 Claims, 10 Drawing Sheets

(56) References Cited

U.S. PATENT DOCUMENTS

| | | | | |
|---|---|---|---|---|
| 4,860,654 | A * | 8/1989 | Chawla et al. | 102/306 |
| 4,860,655 | A * | 8/1989 | Chawla | 102/306 |
| 5,479,860 | A * | 1/1996 | Ellis | 102/313 |
| 6,598,682 | B2 | 7/2003 | Johnson et al. | |
| 6,644,099 | B2 | 11/2003 | Bell | |
| 7,146,913 | B2 | 12/2006 | Bell | |
| 7,284,612 | B2 * | 10/2007 | Ratanasirigulchai et al. | 166/297 |
| 2010/0300690 | A1 * | 12/2010 | Al Busaidy | 166/298 |
| 2011/0011587 | A1 * | 1/2011 | Al Busaidy | 166/297 |

OTHER PUBLICATIONS

M.R.G. Bell et al, Reactive Perforating: Conventional and Unconventional Applications, Learnings and Opportunities: SPE #122174: May 27-29, 2009.

K. Harive et al, Service for Dynamic Scale Removal of Barium Sulfate in Perforation Tunnels:SPE#143244: Jun. 7-10, 2011.

A. Aibusaidyet al: Controlled Wellbore Implosions Show that Not all Damage is Bad: SPE #144080: Jun. 7-10, 2011.

* cited by examiner

TRANSIENT CONTROL OF WELLBORE PRESSURE

CROSS-REFERENCE TO RELATED APPLICATION

Not applicable

BACKGROUND OF THE INVENTION

It is generally recognized that many explosive tools have reduced performance when operating at higher wellbore pressures, particularly above 15,000 psi, when compared to when operating at lower wellbore pressures. The commercially available explosive cutters, for example, work reasonably well at lower hydrostatic pressure, say, below 15,000 psi, but are often marginal or ineffective above that pressure. See U.S. Pat. Nos. 7,146,913 and 6,644,099 to W. T. Bell. Explosive shaped charge cutters and severing tools are often used for critical situations where drill pipe is stuck and needs to be cut and pulled, while an expensive drilling rig is sitting idle, and this becomes more difficult at high pressure.

Perforating guns are also similarly affected by high hydrostatic pressure, as illustrated in FIG. 1. The test series for the FIG. 1 data was performed in a pressure vessel using steel encased Berea sandstone targets. The sandstone was open to the well pressure so that pore pressure in the sandstone was the same as the well pressure. There is a general decline in penetration with increased well pressure, with an apparent 10 percent or so decrease between 4,000 psi and 16,000 psi. The adverse effect of high wellbore pressure is also documented in a paper by Berhmann and Halleck, SPE 18243 "Effects of Wellbore Pressure on Perforator Penetration Depth", 1988.

Higher pressure situations are becoming more frequent in the field and conventional approaches to design are limited in mitigating the effect. For cutters, for example, the traditional approach is to optimize the design by trial and error by increasing explosive, liner shape and density, initiation, which might squeeze out a marginal improvement in cutting at higher pressures. This effort is handicapped by the increased temperature requirements that typically accompany higher pressure, necessitating using an explosive which has inherently lower output, such as HNS. In addition, high pressure requires thicker walled and higher strength tubulars and drill pipe, as well as thicker walled housing for the explosive cutter, making a successful operation more difficult to achieve.

We recognize that if the hydrostatic pressure can be reduced temporarily during the short operating time required for an explosive cutter to initiate and complete the cut, that the cutter's performance could be increased, with an effectiveness that is comparable to operation in a lower pressure environment. One way to do this is to open a volume downhole prior to initiating the cutter. A volume opened quickly reduces the fluid pressure surrounding the cutter at the time of detonation, creating a temporary lower effective hydrostatic pressure for a better cut.

A similar situation occurs with perforating guns when operated at high hydrostatic pressures. The formation rock in these situations often has high compressive strength which can further reduce penetration. Shaped charge manufacturers can mitigate this somewhat with designs that are tailored to the high strength rock, but the wellbore pressure effect would still be present. Again, a temporary lowering of pressure in the wellbore surrounding the gun at the time that the gun initiates could increase the resulting penetration in the formation.

Conventional perforating gun systems sometimes use an empty chamber or gun volume that creates a dynamic underbalance. Although, sometimes effective in removing perforating damage through surge flow, the underbalance occurs too late to affect the penetration process itself: the shaped charge jet still has to penetrate through the high pressure fluid in the wellbore.

Perforating guns that have shaped charges with liners that contain reactive materials may be particularly susceptible to this same effect because the bulk of the reactive products are in the trailing slug and arrive inside the perforations at a later time than the jet that produces the perforation. See Bell, M. R. G., Hardesty, J. T., Clark, N. G. "Reactive Perforating: Conventional and Unconventional Applications, Learnings and Opportunities", SPE122174, SPE European Formation Damage Conference, Netherlands, 27-29 May 2009. The effectiveness of these types of charges require that both the jet and the slug reach the perforation, meaning that there is more time for interference to occur and making the charge performance more susceptible to interference at high hydrostatic pressures.

The background above describes problems in performance of explosive devices at high hydrostatic wellbore pressure. Implicit in the understanding of the effect is that a lower hydrostatic pressure can alleviate some of the problem. Our invention couples explosive devices with existing implosion devices in a unique way to counter much of the wellbore pressure effect by a transient reduction of that pressure at the time of firing an explosive device. Our invention can also be used to control or modify the transient pressure at some remote position in the wellbore. Unregulated transient pressures from initiating an explosive device such as a perforating gun can upset plugs or packers, for example. By properly timed initiation of an auxiliary implosion or explosive device, the net transient pressure at a plug can be significantly reduced.

There are several applications for transient control of pressure down hole by opening a chamber to the surrounding fluid. One was suggested in the 1980s to create a controlled implosion for a downhole seismic application. See U.S. Pat. No. 4,805,726 to D. Thomas Taylor et al. Later, the idea was expanded to improve operations by inducing a dynamic underbalance during perforating, allowing better perforation cleanup by creating a favorable differential pressure between the formation and the wellbore for a short period of time. Later, this idea was incorporated into U.S. Pat. No. 6,598,682 to Ashley B. Johnson et al. In more recent years, implosion chambers have been used successfully to clean up existing scaly perforations by the surge created when a chamber is suddenly opened. See Harive, Kevin, Le, Cam, Khalek, Mohamed Abdel, "Service for Dynamic Scale Removal of Barium Sulfate in Perforation Tunnels," SPE 143244, SPE European Formation Damage Conference, Netherlands, 7-10 Jun. 2011 and Busaidy, Adil Al, Zaouali, Zouhir, Baumann, Carlos Erik, Vegliante, Enzo, "Controlled Wellbore Implosions Show that Not All Damage is Bad—A New Technique to Increase Production from Damaged Wells," SPE 144080, SPE European Formation Damage Conference, Netherlands, 7-10 Jun. 2011. When used with perforating guns for transient underbalance cleanup, these implosion chambers are typically initiated at the same time or within less than a millisecond of firing the perforating gun, all by firing a single detonator.

SUMMARY OF THE INVENTION

The invention we present here combines implosion and explosive devices by sequenced timing of the actuation of each device to create a favorable transient wellbore pressure that optimizes performance of an explosive cutter or formation perforator. In one embodiment, the ill effect of high wellbore pressure reducing formation penetration of a perforating gun or an explosive pipe, casing or tubing cutter is mitigated by the actuation of an implosion device several milliseconds before initiating the gun or cutter. Several control unit embodiments are described that determine the timed sequence of the initiations of the implosion and explosive device.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

An "implosion device" as defined and used herein is a downhole tool that creates a net reduction in wellbore pressure when actuated by itself. It may be activated by initiating a small amount of propellant to open an empty tool volume to the surrounding wellbore such as by moving a tool sleeve. It can also be accomplished by using a number of small puncher charges to punch holes in the wall of an empty chamber thereby exposing the chamber to the wellbore.

An "explosive device" as defined herein is a downhole tool that creates a net increase in wellbore pressure when actuated by itself. Propellant guns used to create high pressure are one example; explosive cutters are another.

It should be noted that a perforating gun can be either an explosive device or an implosion device, depending on the magnitude of the wellbore pressure and the amount of explosive contained within the gun. If the wellbore pressure is higher than the resulting internal pressure from detonating the charges, the gun may be considered an implosion device, for example. And if the wellbore pressure is lower, then the gun may be considered an explosive device.

Figure 1:
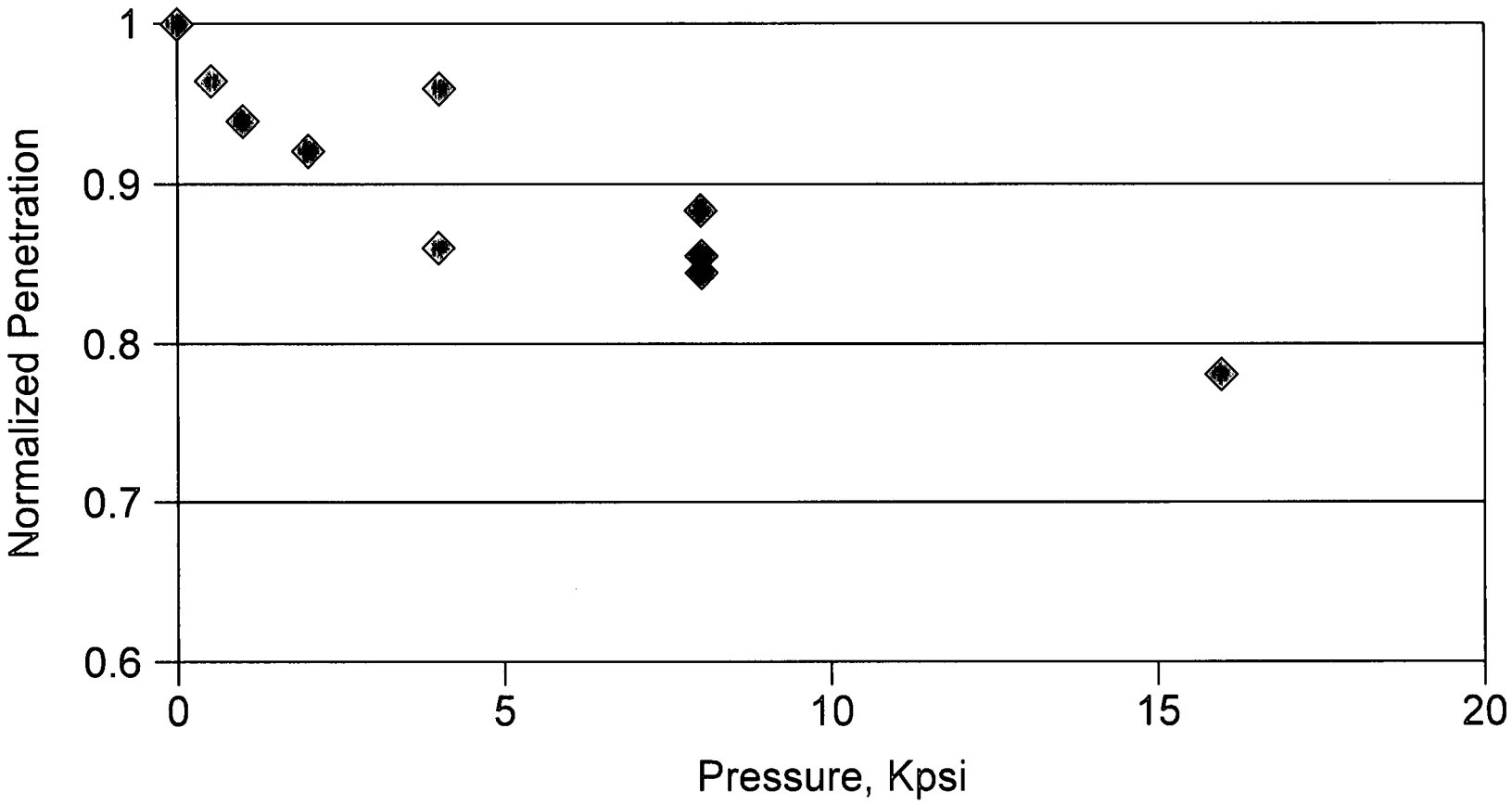
FIG. 1 is a graph of normalized perforating gun penetration into Berea sandstone at various wellbore pressures.
Figure 2:
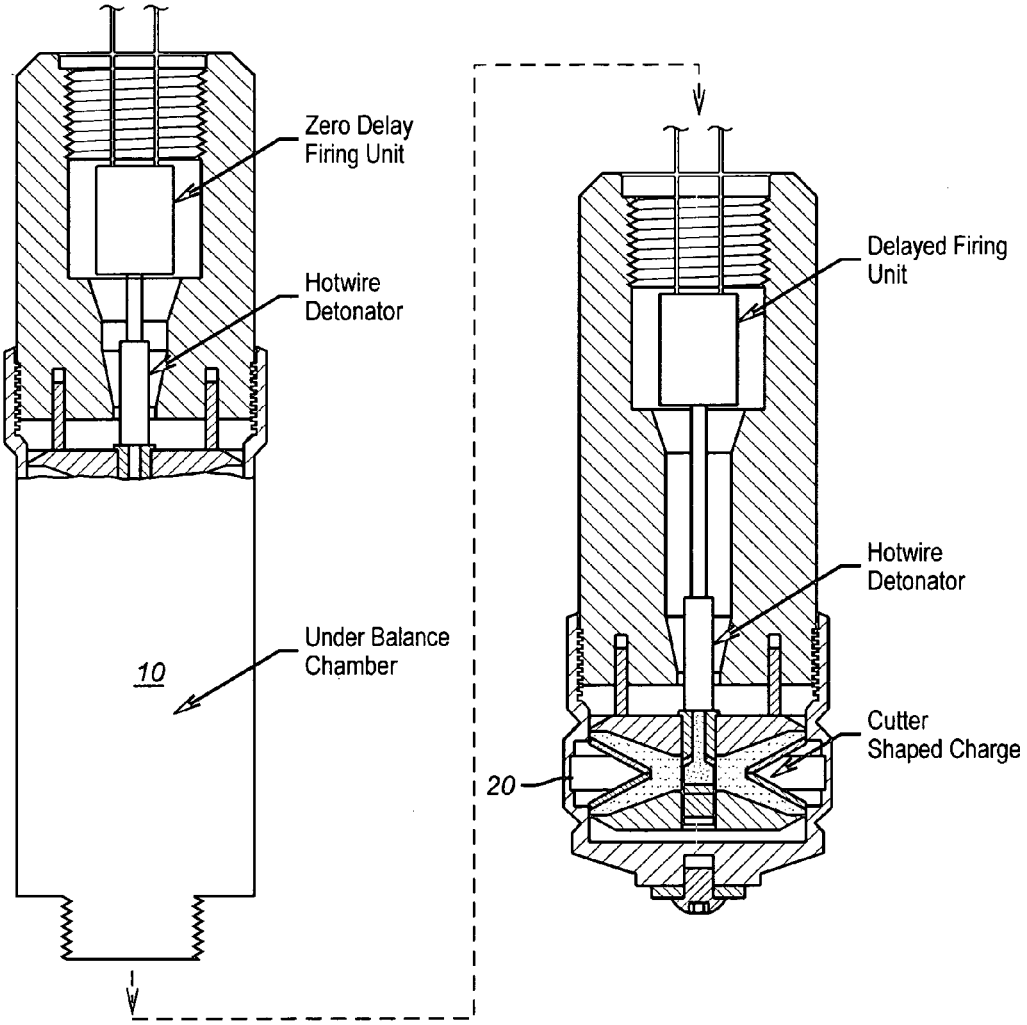
FIG. 2 is the schematic of the invention including an implosion chamber and a shaped charge explosive pipe cutter.

One embodiment of the invention is shown in FIG. 2. It comprises an empty chamber segment 10 of a downhole pipe or tubing string that may be opened abruptly by command from the surface at a time to and an explosive cutter 20 that is programmed to initiate at a delayed time $t_0+\Delta t$. The empty chamber 10 need be of no particular configuration but provide a volumetric void in the immediate vicinity of the cooperative cutter 20. A similar embodiment of the invention combines the empty chamber 10 with a perforating gun not shown. When the chamber is first opened, the hydrostatic pressure surrounding the chamber and cutter drops suddenly, then recovers as fluid fills the chamber. The amount of pressure drop and its recovery depends on the design of the chamber device, its dimensions, the surrounding geometry and pressure, and can be calculated with commercially available software such as SurgePro. The cutter is then initiated at the prescribed delay time.

In the embodiment of FIG. 2, the initiation of the opening of the chamber and the initiation of the cutter use detonators, which can be of several types including hot-wire detonators, and detonators that use semiconductor bridges, exploding foils and exploding bridge wires, each type having its own characteristic firing time that enters into the calculation of $\Delta t$. and its own circuitry.

Figure 3:
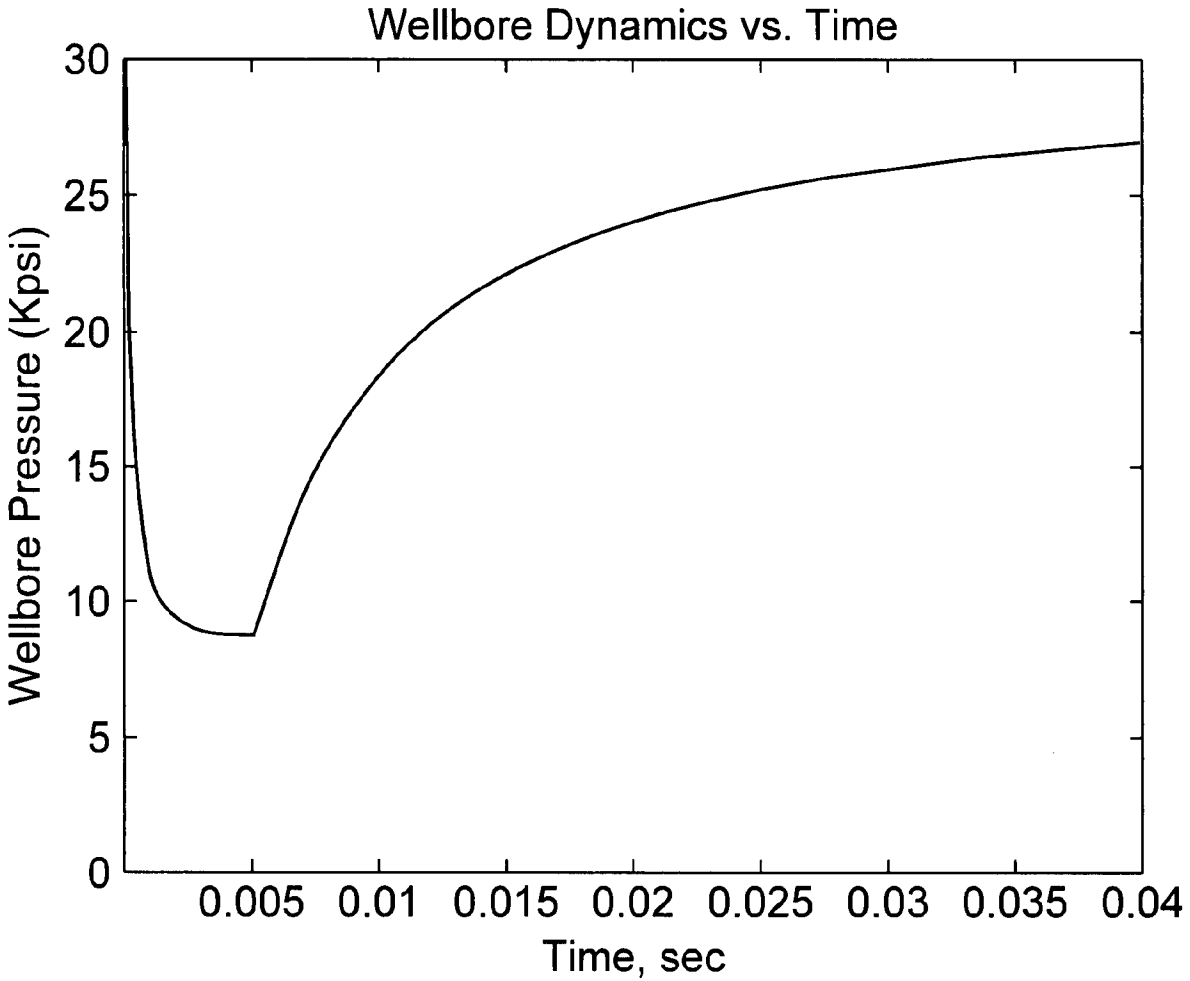
FIG. 3. Is a graph of the dynamic wellbore pressure response from opening an implosion chamber when the hydrostatic pressure is 30,000 psi.

A typical dynamic response is shown in FIG. 3. Here, it may be seen that the wellbore fluid pressure in the vicinity immediately surrounding the empty chamber volume reduces quickly from the hydrostatic, in this example from 30,000 psi to 8,000 psi, in about 5 milliseconds, before it begins recovering. The minimum dynamic pressure depends primarily on the volume of the chamber 10, the initial wellbore pressure and the wellbore annulus volume surrounding the chamber 10. The duration of the low pressure "sweet spot" near the pressure minimum lasts only a few milliseconds. This is the time $t_0+\Delta t$ at which the explosive cutter or perforating gun initiates. Since the total time for the cutter 20 to complete its cut or for a perforating gun to produce holes in a formation is less than a millisecond, a few milliseconds at low pressure is more than enough time for the explosive device to complete its job without its jet being affected by an otherwise high hydrostatic pressure fluid.

Figure 4:
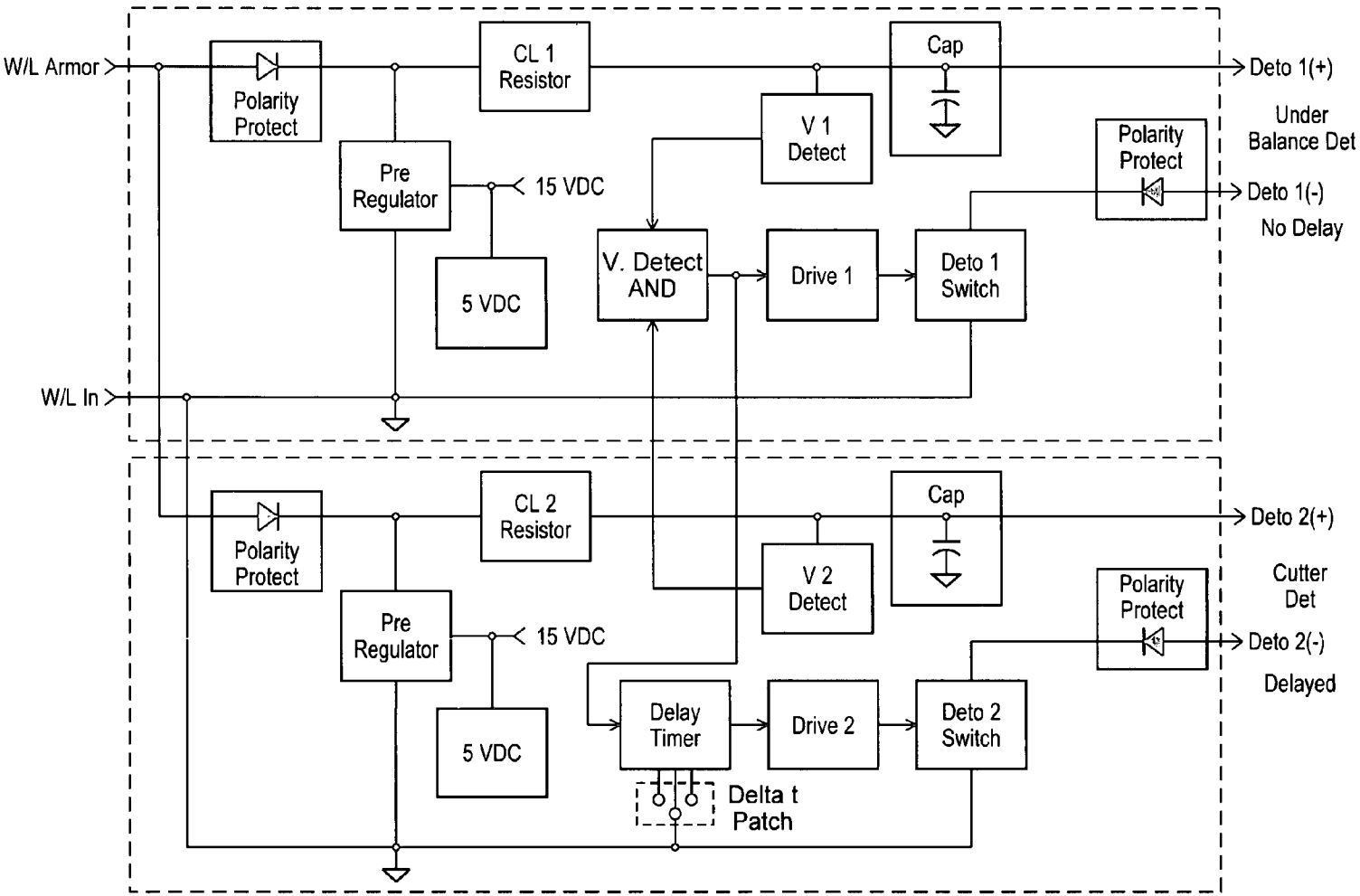
FIG. 4 is a block diagram for an apparatus that will fire two detonators with a predetermined time delay FIG. 5. is a flow chart of the method sequence for firing two devices with a selected time delay

A preferred embodiment of the time delay mechanism portion of the system contemplates usage with hot wire detonators, but those skilled in the art may conceive of similar designs for other detonator types, as well as variations on the circuitry disclosed here. FIG. 4 shows a block diagram of circuitry to fire two detonators with a programmed time delay. The dual detonator arrangement provides a method for independently firing two hot-wire detonators having a predetermined delay between the two. The two firing circuits are electrically in parallel with the wireline, which is composed of a first and second conductor. In addition, two control signals are shared between the two circuits: (a) a voltage detect signal between the explosive control unit to the implosion control unit and (b) a trigger signal from the implosion circuit to the explosive circuit.

Operation of the circuit is described below:

1. Apply shooting power supply voltage from the surface
2. The internal power supplies of both circuits are energized
3. The detonator firing capacitor for both circuits begins to charge through the polarity protect diodes and current limit resistors.
4. When the firing capacitors reach a predetermined voltage, a logic signal is generated by the each voltage detect (1) and voltage detect (2).
5. The voltage detect signals (1 and 2) are routed into logical "AND" gate. With both signals present the voltage detect "AND" gate generates a trigger pulse. The trigger pulse is routed to driver (1) and the delay timer of circuit 2.

6. The trigger pulse causes the detonator on circuit 1 to fire immediately.
7. The trigger pulse routed to circuit 2 starts a delay timer. After a predetermined delay the detonator in circuit 2 fires.

Figure 5:
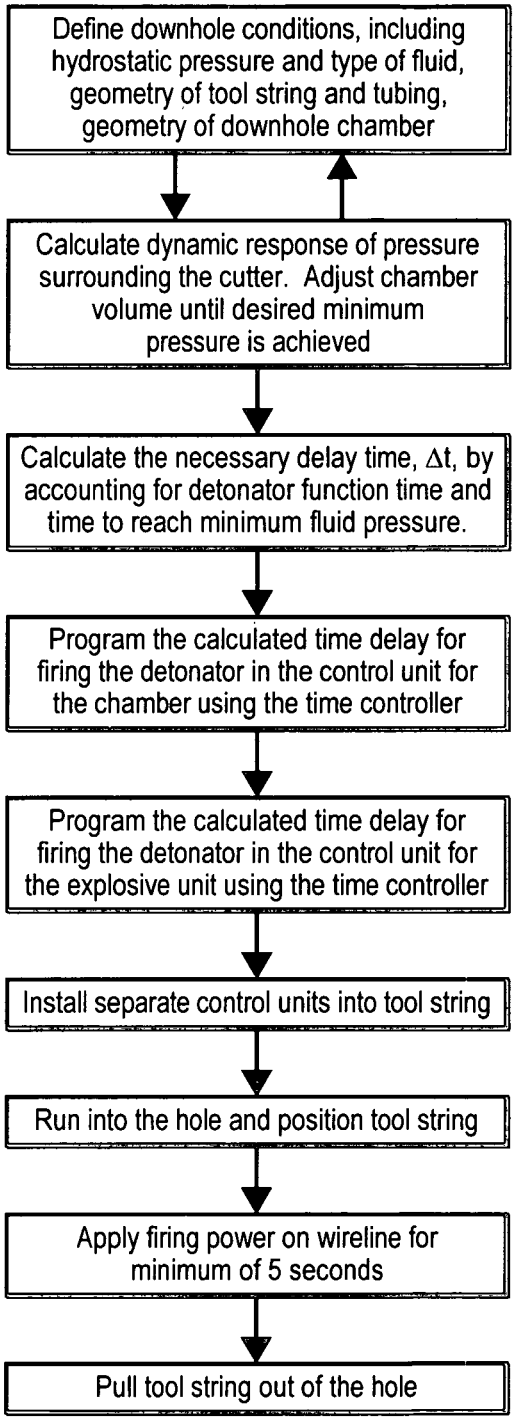

A flow chart of FIG. 5 shows the procedure used in preparing and executing a high pressure job with an explosive device.

There are several approaches to effect a time delay between explosive events downhole. The one described above in FIGS. 4 and 5 has the advantage that no special equipment is needed at the surface to start the timing delay sequence. The disadvantage is that the downhole control circuitry needs to be protected from the detonation of the first device so that control power is maintained at the second device.

Figure 6:
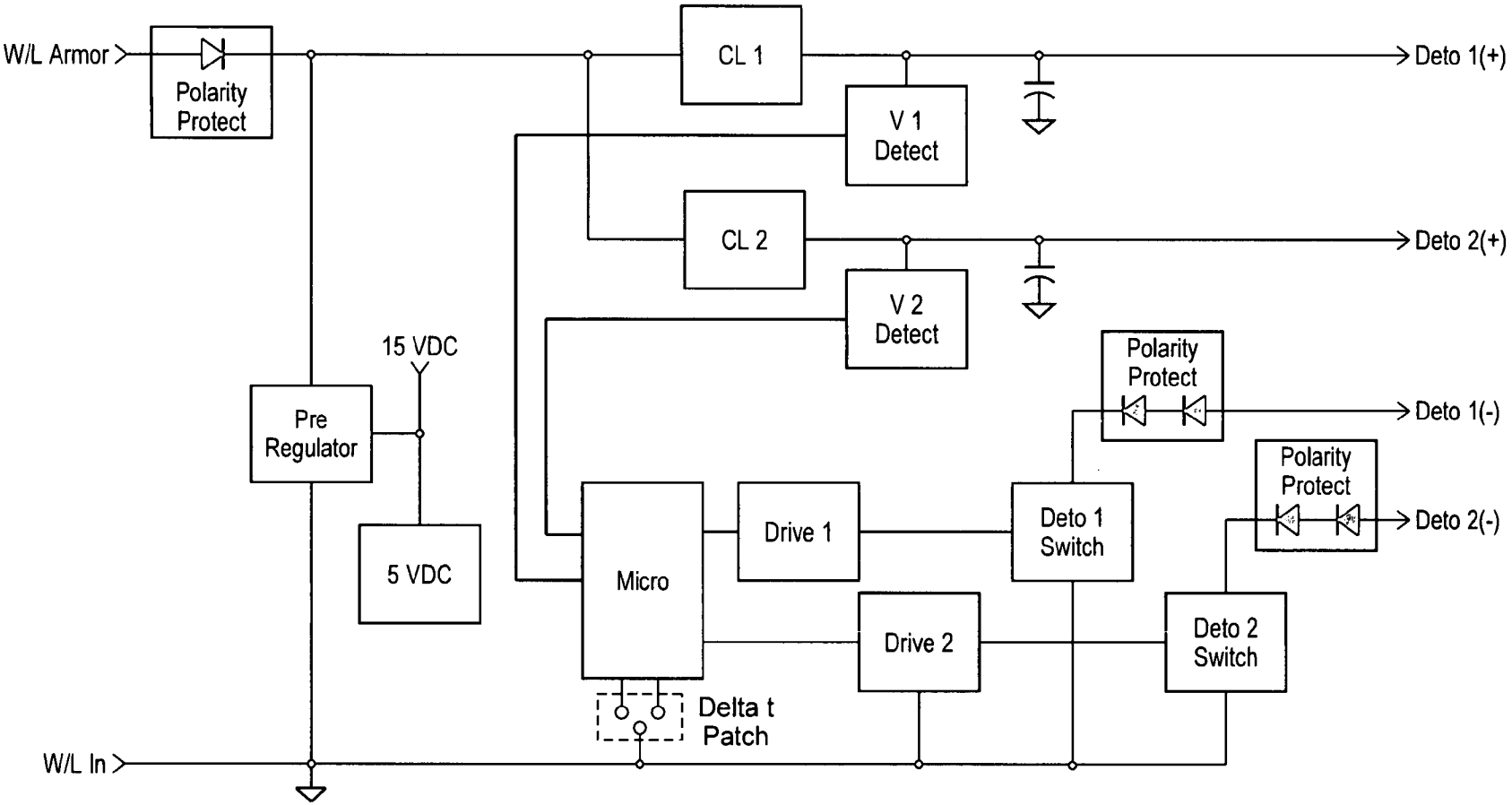
FIG. 6 is a block diagram for an apparatus having dual detonations with voltage control initiation and a micro delay
Figure 7:
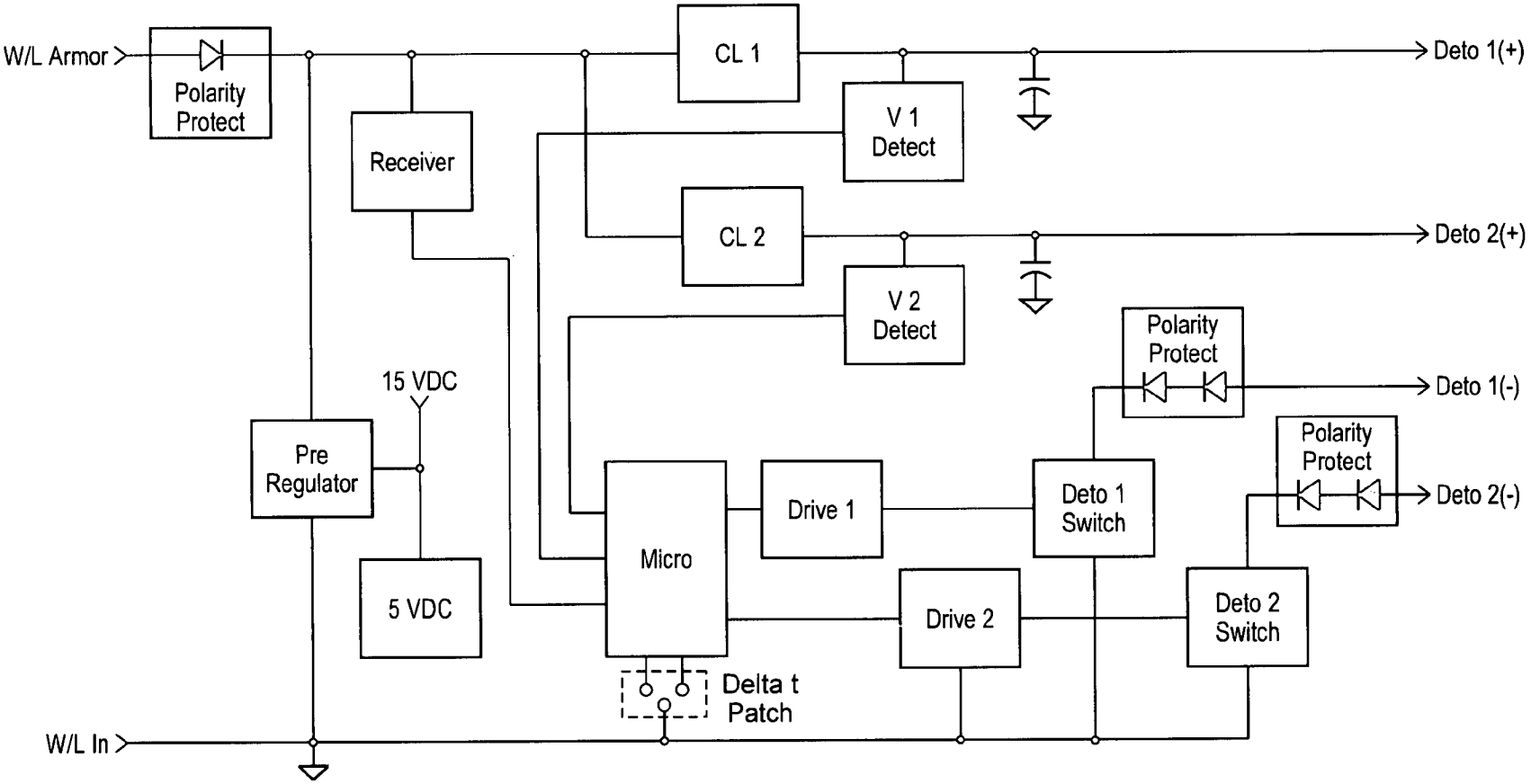
FIG. 7 is a block diagram for an apparatus having dual detonations with voltage detection, micro delay and surface initiation
Figure 8:
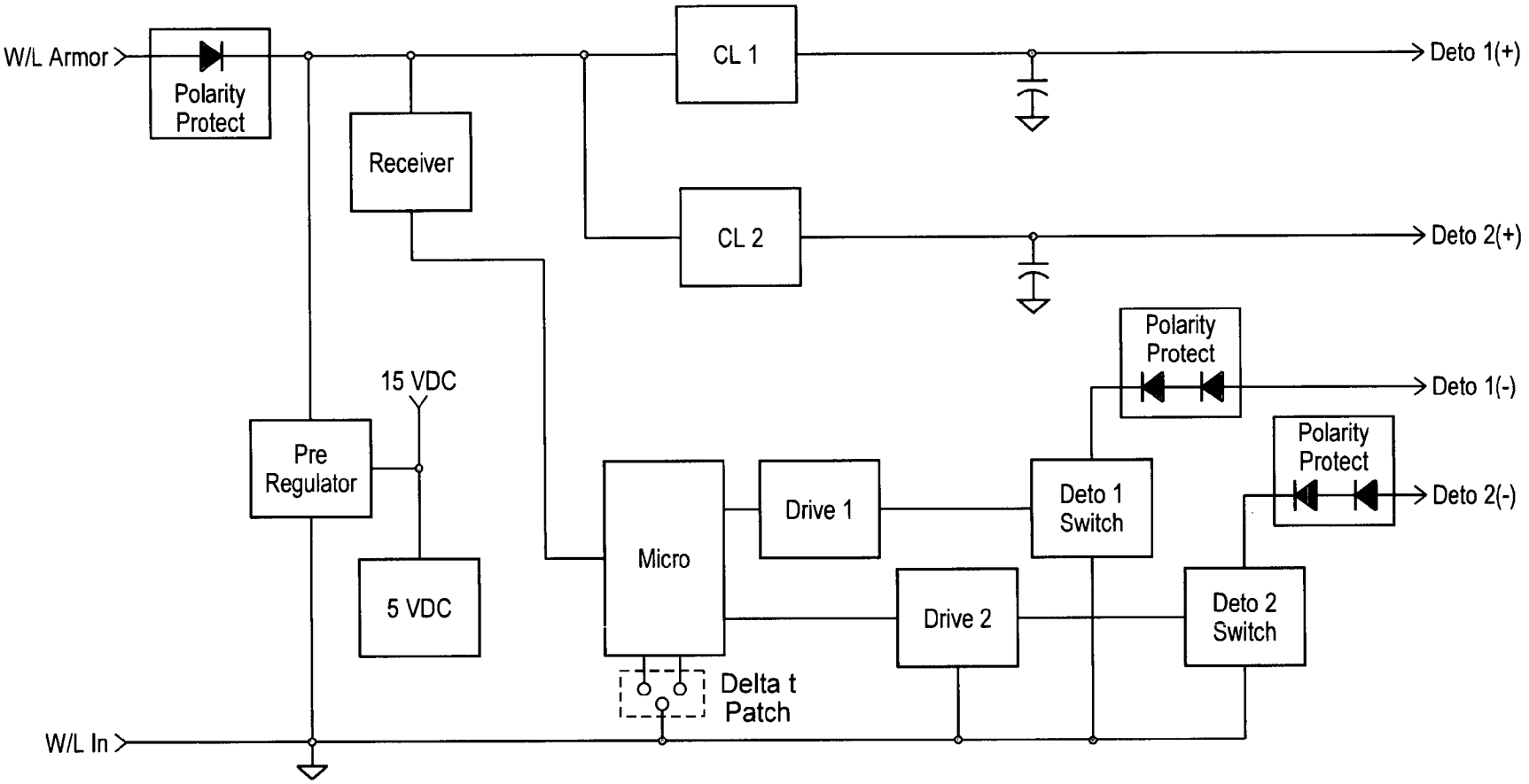
FIG. 8 is a block diagram for an apparatus having dual detonations with micro delay and surface initiation

Other variations of the one described in FIGS. 4 and 5 are shown in FIGS. 6, 7 and 8.

Figure 9:
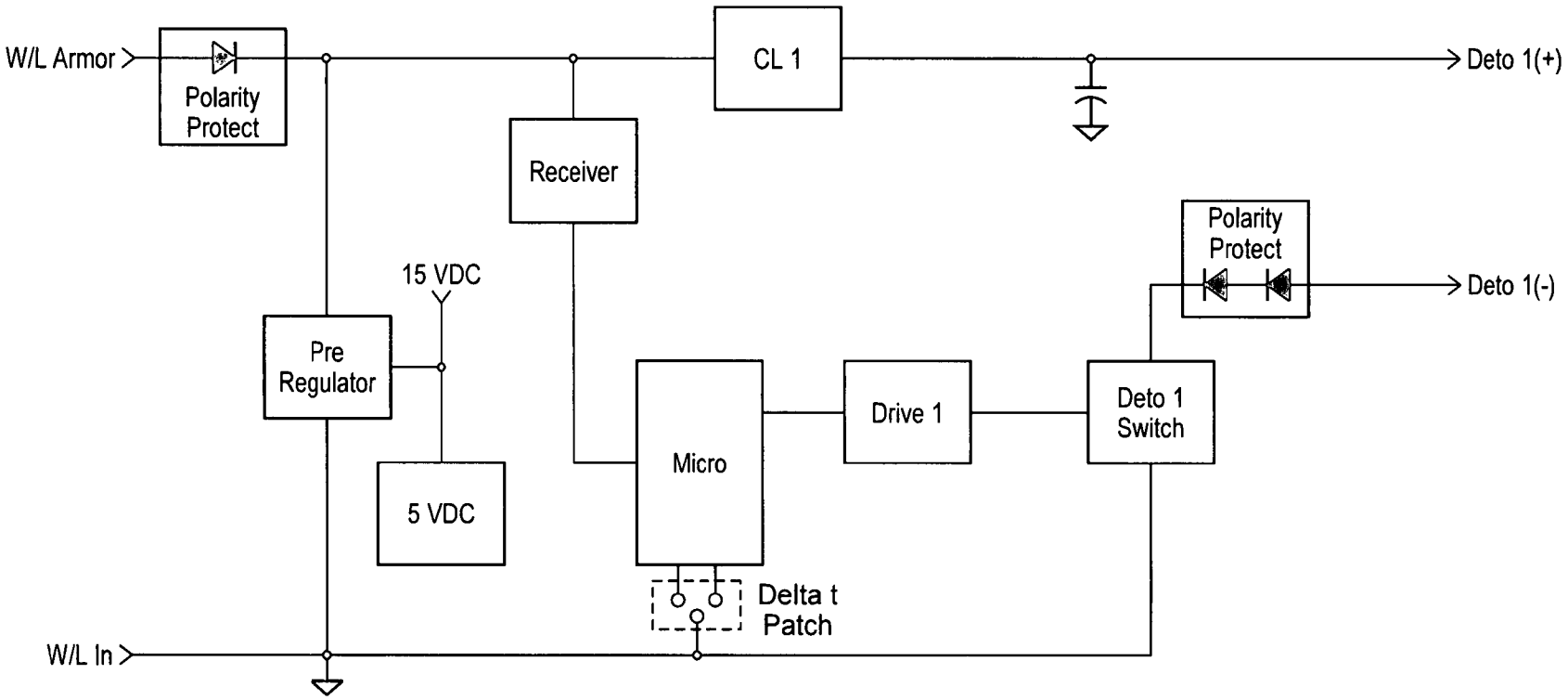
FIG. 9 is a block diagram for an apparatus having single detonations and surface initiation
Figure 10:
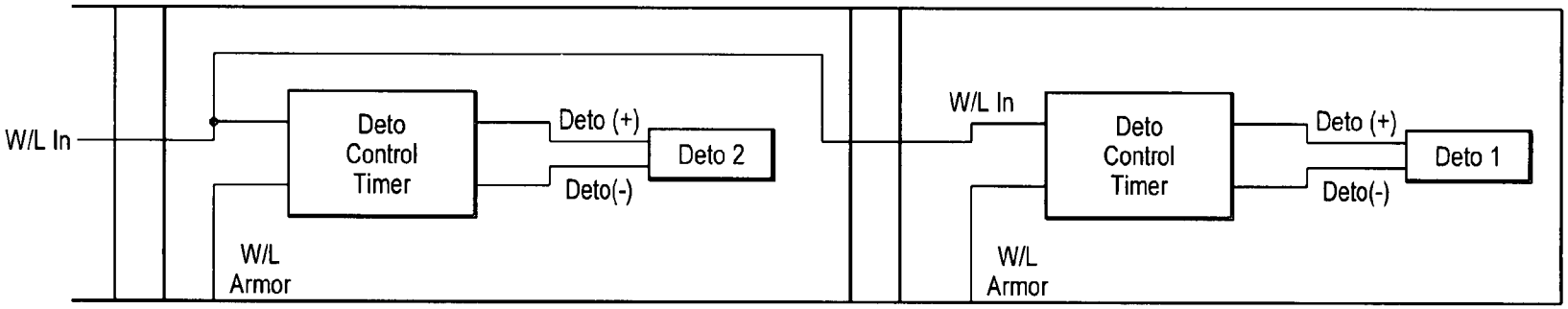
FIG. 10 is a block diagram for an apparatus having dual guns with detonation delay and surface initiation

Another embodiment of the time delay mechanism, shown in FIGS. 9 and 10, is a variation of the one above. It differs in that electrical isolation of the detonation events is not required. It does require, however, a separate power supply at the surface to activate the firing sequence.

The embodiment consists of an electrical circuit that is attached to each detonator, where the circuit-detonators units are connected electrically in parallel. The circuit consists of a receiver, microprocessor, capacitor that is capable of firing the detonator when fully charged and a switch (typically a FET) that allows the charged capacitor to discharge into the detonator by command from a surface signal. The microprocessor is programmed to connect the detonator to the capacitor upon receipt of a special signal from the surface.

The capacitor is charged up by the application of DC voltage from a power supply at the surface that is connected to the wireline. Once the capacitor is fully charged, a signal is sent down the wireline that is received by each unit that starts an internal timer in each unit to then cause a timed discharge of the capacitor voltage through a FET to fire the unit's detonator. Each unit has a fully charged capacitor that allows the unit to fire independently of the firing of other units, obviating the problem of having one firing and preventing the firing of another by an electrical short.

Another application of having units with timing delays that can fire detonators independently without shorting is to increase the firing reliability of an explosive device by "double capping" the explosive initiation. For example, one unit with detonator can be attached to one end of the detonating cord in a perforating gun and another to the other end. Then both commanded to fire. The reliability for firing is therefore multiplied. The overall reliability of the detonators firing the gun is approximately the product of each firing (e.g., if the individual misfire rate of a single detonator is 1/100, the approximate reliability of firing of at least one of the two detonators, and thus firing the gun, is 1/10,000).

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A downhole perforating or cutting system comprising:
a surface power supply;
a subsurface implosion device;
a subsurface explosive device;
a first subsurface power supply adapted to activate the implosion device;
a second subsurface power supply and an electronic time delay adapted to activate the explosive device; and
a wireline linking the surface power supply to the first and second subsurface power supplies in parallel.

2. The downhole perforating or cutting system of claim 1 wherein:
the first subsurface power supply comprises a first capacitor and a first switch; and
the second subsurface power supply further comprises a second capacitor and a second switch.

3. The downhole perforating or cutting system of claim 2 further comprising:
a first voltage detect adapted to detect the voltage of the first capacitor;
a second voltage detect adapted to detect the voltage of the second capacitor;
a voltage trigger gate electrically connected to the first and second voltage detect;
wherein the voltage trigger gate is adapted to send an activation signal for the first and second subsurface power supplies when the voltage detected by the first and second voltage detects are above a predetermined threshold.

4. The downhole perforating or cutting system of claim 3 further comprising:
a first polarity protect between a first conductor in the wireline and the first subsurface power supply; and
a second polarity protect between a first conductor in the wireline and the second subsurface power supply.

5. The downhole perforating or cutting system of claim 4 further comprising:
a third polarity protect between the first subsurface power supply and the implosion device; and
a fourth polarity protect between the first subsurface power supply and the explosive device.

6. The downhole perforating or cutting system of claim 3 further comprising:
a first current limiting resistor between a first conductor in the wireline and the first subsurface power supply; and
a second current limiting resistor between a first conductor in the wireline and the second subsurface power supply.

7. The downhole perforating or cutting system of claim 2 further comprising:
a subsurface communications receiver communicating with the surface through a first conductor in the wireline and a subsurface microprocessor.

8. The downhole perforating or cutting system of claim 7 further comprising:
a first voltage detect adapted to detect the voltage of the first capacitor;
a second voltage detect adapted to detect the voltage of the second capacitor;
wherein the microprocessor is electrically connected to the first and second voltage detect and the microprocessor is adapted to send an activation signal for the first and second subsurface power supplies when the voltage detected by the first and second voltage detects are above a predetermined threshold.

9. The downhole perforating or cutting system of claim 8 further comprising:

a first polarity protect between a first conductor in the wireline and the first subsurface power supply; and a second polarity protect between a first conductor in the wireline and the first subsurface power supply.

10. The downhole perforating or cutting system of claim 9 further comprising:

a third polarity protect between the first subsurface power supply and the implosion device; and a fourth polarity protect between the first subsurface power supply and the explosive device.

11. The downhole perforating or cutting system of claim 8 further comprising:

a first current limiting resistor between the first conductor and the first subsurface power supply;

and a second current limiting resistor between the first conductor and the first subsurface power supply.

12. A downhole perforating or cutting system comprising:

a surface power supply;

a surface transmitter;

a subsurface implosion device;

a subsurface explosive device;

a first subsurface power supply having a first electronic time delay adapted to activate the implosion device;

a second subsurface power supply having a second electronic time delay adapted to activate the explosive device;

a wireline linking the surface power supply to the first and second subsurface power supplies in parallel;

a first subsurface receiver adapted to receive communications form the surface transmitter through a wireline;

a second subsurface receiver adapted to receive communications form the surface transmitter through a wireline;

wherein the first and second subsurface receivers are adapted to receive signals from the surface transmitter.

13. The downhole perforating or cutting system of claim 12 wherein:

the first subsurface power supply further comprises a first capacitor, a first microprocessor, and a first switch; and the second subsurface power supply further comprises a second capacitor, a second microprocessor, and a second switch.

14. The downhole perforating or cutting system of claim 13 wherein:

the first subsurface receiver is adapted to send an activation signal to the first microprocessor in response to an activation signal from the surface transmitter;

the second subsurface receiver is adapted to send an activation signal to the second microprocessor in response to an activation signal from the surface transmitter;

the first microprocessor is adapted to activate the first switch a first predetermined time after receiving the activation signal from the first subsurface receiver; and the second microprocessor is adapted to activate the second switch a second predetermined time after receiving the activation signal from the second subsurface receiver.

15. A method of underbalance perforating a wellbore comprising:

electrically connecting a surface power supply to an implosion device and a perforating gun;

providing the implosion device with a first downhole power supply;

providing the perforating gun with a second downhole power supply having a predetermined electronic time delay;

introducing the implosion device and the perforating gun into the wellbore;

energizing the first and second downhole power supplies with the surface power supply;

activating the first downhole power supply;

activating the predetermined electronic time delay simultaneously with the first downhole power supply;

activating the implosion device with the first downhole power supply;

after the predetermined electronic time delay, activating the perforating gun with the second downhole power supply.

16. The method of underbalance perforating a wellbore of claim 15 wherein:

activating the first downhole power supply comprises closing a switch in the first downhole power supply; and activating the second downhole power supply comprises closing a switch in the second downhole power supply.

17. The method of underbalance perforating a wellbore of claim 16 wherein:

energizing the first and second downhole power supplies further comprises charging a first and second capacitor.

18. The method of underbalance perforating a wellbore of claim 17 further comprising:

detecting that the first and second capacitors are charged;

wherein the first downhole power supply and the second downhole power supply time delay are not activated until after detecting that the first and second capacitors are both charged.

19. A method of underbalance cutting a downhole tubular comprising:

electrically connecting a surface power supply to an implosion device and a tubing cutter;

providing the implosion device with a first downhole power supply;

providing the tubing cutter with a second downhole power supply having a predetermined electronic time delay;

introducing the implosion device and the tubing cutter into the wellbore;

energizing the first and second downhole power supplies with the surface power supply;

activating the first downhole power supply;

activating the predetermined electronic time delay simultaneously with the first downhole power supply;

activating the implosion device with the first downhole power supply;

after the predetermined electronic time delay, activating the tubing cutter with the second downhole power supply.

20. The method of underbalance cutting a downhole tubular of claim 19 wherein:

activating the first downhole power supply comprises closing a switch in the first downhole power supply;

activating the second downhole power supply comprises closing a switch in the second downhole power supply; and energizing the first and second downhole power supplies further comprises charging a first and second capacitor.

21. The method of underbalance cutting a downhole tubular of claim 20 further comprising:

detecting that the first and second capacitors are charged;

wherein the first downhole power supply and the second downhole power supply time delay are not activated until after detecting that the first and second capacitors are both charged.

* * * * *